US005301574A

United States Patent [19]

Knopp et al.

[11] Patent Number: 5,301,574

[45] Date of Patent: Apr. 12, 1994

[54] HYDRAULIC WRENCH

[75] Inventors: Brian Knopp; Harry J. Knopp, both of West Newton; Paul B. Stork, Belle Vernon, all of Pa.

[73] Assignee: Bolttech Inc., West Newton, Pa.

[21] Appl. No.: 25,131

[22] Filed: Mar. 2, 1993

[51] Int. Cl.[5] ..... B25B 13/46

[52] U.S. Cl. ..... 81/57.39; 81/57.24

[58] Field of Search ..... 81/57.39, 57.24, 57.29, 81/57.28, 57.4, 57.46

[56] References Cited

U.S. PATENT DOCUMENTS

| | | | |
|---|---|---|---|
| 3,930,776 | 1/1976 | Keller | 173/163 |
| 3,972,242 | 8/1976 | Hunt | 74/30 |
| 4,266,444 | 5/1981 | Anderson et al. | 74/661 |
| 4,336,727 | 6/1982 | Junkers | 81/57 |
| 4,794,825 | 1/1989 | Schmoyer | 81/57 |
| 5,090,273 | 2/1992 | Fossella | 81/57 |
| 5,097,730 | 3/1992 | Bernard et al. | 81/57 |

*Primary Examiner*—D. S. Meislin

*Attorney, Agent, or Firm*—Jacobson, Price, Holman & Stern

[57] ABSTRACT

A hydraulic wrench is provided of minimum external dimensions and yet constructed in a manner to be capable of exerting relatively high torsional forces. The wrench is constructed to be driven by a hydraulically reciprocal piston carrying a rack gear thereon with the rack gear meshed with a reciprocal sector gear having a pawl pivotally supported therefrom for driving a ratchet-type power wheel of the wrench. The wrench is provided with a variably positionable and reversable reaction bar or abutment assembly on the end thereof remote from the power wheel and the wrench further includes a secondary deactivatable ratchet pawl for preventing reverse rotation of the main ratchet-type drive wheel of the wrench.

9 Claims, 3 Drawing Sheets

HYDRAULIC WRENCH

BACKGROUND OF THE INVENTION

1. Field of the Invention

This invention relates to a hydraulic wrench utilizing a reciprocal driven rack gear to oscillate a pinion gear segment including a one way driving connection with a ratchet gear through a pawl pivotally supported from the pinion gear segment, the hydraulic wrench being constructed of minimum dimensions for maximum power and including structure by which the wrench may be utilized to reversely drive a bolt or nut. Further the wrench is equipped with a variably positionable reactionary force abutment to facilitate ease in utilization of the hydraulic wrench.

2. Description of Related Art

Various different forms of hydraulic wrenches including some of the general structural and operational features of the instant invention heretofore have been provided such as those disclosed in U.S. Pat. Nos. 3,972,242, 3,930,776, 4,266,444, 4,336,727, 4,794,825, 5,090,273 and 5,097,730. However, these previously known forms of hydraulic wrenches and other similar devices do not include or suggest the overall combination of structural and operational features included int he instant invention.

SUMMARY OF THE INVENTION

The hydraulic wrench of the instant invention has been designed, of course, to exert high torsional forces, but further has been designed as a compact tool usable in confined areas and including structure which will enable the direction of rotational torque developed to be readily reversed. In addition, the tool incorporates a force reaction abutment which may be variously adjusted in position on its mounted area of the tool and is efficiently usable to provide the desired reactionary force abutment in substantially all working environments.

Still further, the tool incorporates a ratchet type drive including not only a main ratchet for effecting rotational torque, but also a selectively usable secondary ratchet to prevent the tool from becoming bound in certain working environments.

The tool also incorporates a housing which is fabricated from various components including several which are permanently joined together during construction and two which are removably supported from the remainder of the housing component to allow for repair and replacement of internal components.

The main object of this invention is to provide a compact hydraulic wrench capable of developing high torque forces and which may be readily operated to apply it's torque forces in opposite directions of rotation.

Another object of this invention is to provide a hydraulic wrench equipped with a reaction abutment or bar which may be adjusted to various predetermined positions in relation to the housing of the wrench to thereby enable the wrench to be utilized in many different environments.

Another important object of this invention is to provide a hydraulic wrench which, in concert with the reaction bar or abutment referred to above, utilizes a hexagonal housing to provide a twentyfour position capacity of the reaction bar or abutment and also to provide a cylinder housing of structural strength to offset torsional deflection and other stresses created in the wrench.

Another very important object of this invention is to provide a hydraulic wrench incorporating lubrication passages for external lubrication of all of the internal torque developing components of the invention independent of the hydraulic cylinder portion thereof.

A final object of this invention to be specifically enumerated herein is to provide a hydraulic in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
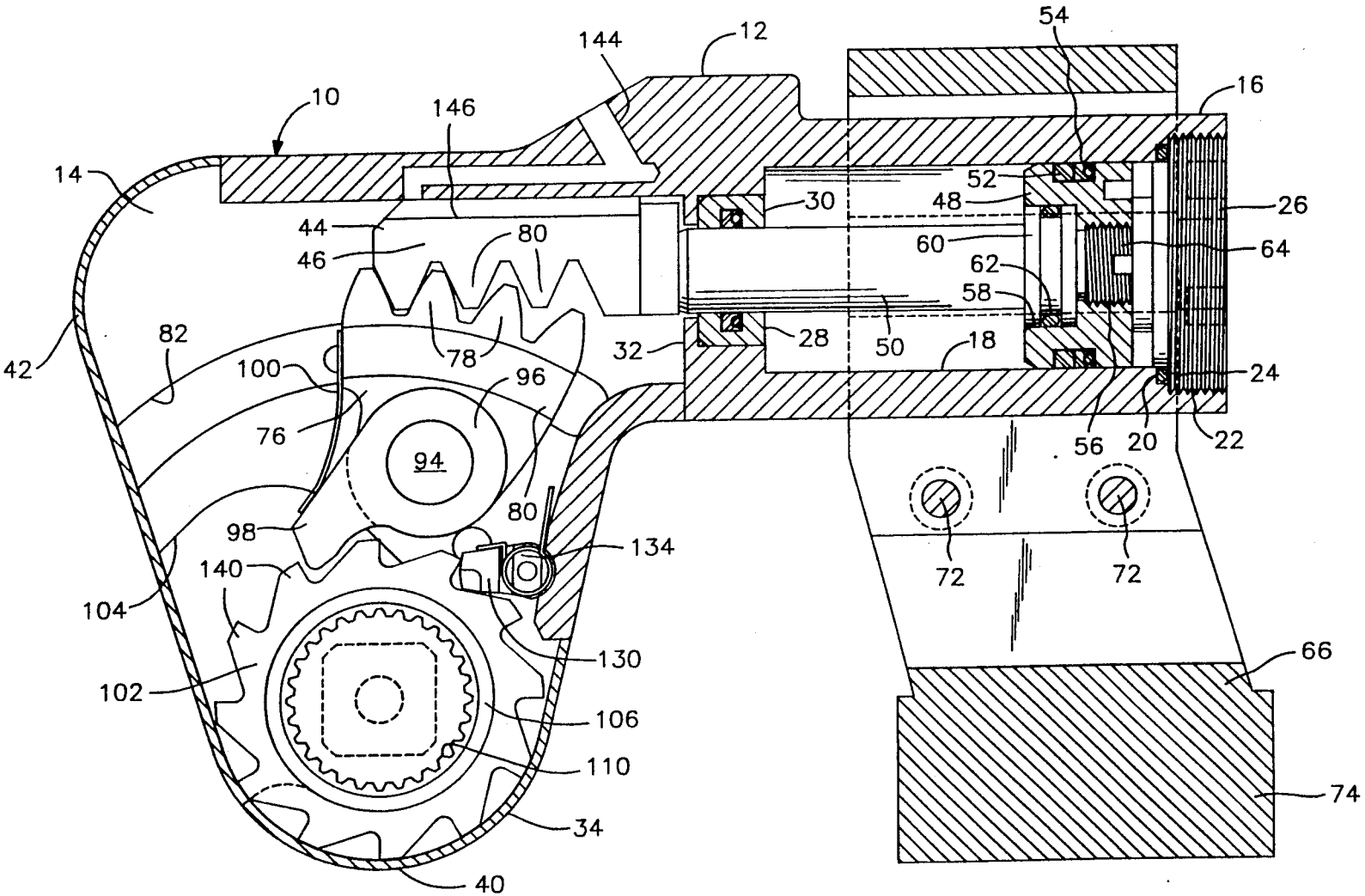
FIG. 1 is a longitudinal vertical sectional of a hydraulic wrench constructed in accordance with the present invention.

Referring now more specifically to the drawings the numeral 10 generally designates the hydraulic wrench of the instant invention. The wrench 10 includes an elongated hollow body 12 having front and rear ends 14 and 16.

The rear end 16 includes a central piston bore 18 formed therein and opening endwise outwardly thereof. The rear end of the bore 18 includes first and second counter bores 20 and 22 for receiving an O-ring 24 and a threaded plug 26, respectively.

The front end of the piston bore 18 includes a diametrically reduced section 28 thereof in which a piston shaft seal assembly 30 is received and the diametrically reduced section 28 is shouldered as at 32 for maintaining the seal assembly 30 in position.

The area forward of the shoulder 32 defines the front end 14 of the body 12 and the front end 14 includes a downwardly offset lower portion 34 extending between lower extremities of the body side walls 36 and 38 which are initially pinned in position relative to the remainder of the body 12 and then fixedly secured in position by braising or welding (not shown). A fixed lower wall portion 40 extends between the lower extremities of the side walls 36 and 38 and closes the lower portion 34 of the front end 14 and the front extremity of the front end 14 is removably closed by a removable front wall 42.

An elongated rack gear 44 is provided including a rack gear portion 46 on its forward end, a piston assembly 48 on its rear end and an intermediate piston shaft portion 50. The piston shaft portion 50 is sealingly slidingly received through the seal assembly 30 and the piston assembly 48 is sealingly slidingly received within the piston ore 18, the outer periphery of the piston assembly 48 including circumferential seals 52 and 54. The piston assembly 48 includes a threaded bore 56 formed therethrough including a forward end counter bore 58. A diametrically enlarged portion 60 is formed on the rear end of the piston shaft portion 50 and is sealingly received within the counter bore 56 through the utilization of an O-ring seal 62 and the rearmost extremity of the piston shaft portion 50 includes a threaded terminal 64 removably threadedly engaged in the threaded bore 56. In this manner, the piston assembly 48 is removably and sealingly secured to the rear end of the piston shaft portion 50. Additionally, the rear end of the piston bore 18 is removably closed by the threaded plug 26 and sealed against leakage by the O-ring 24.

Figure 5:
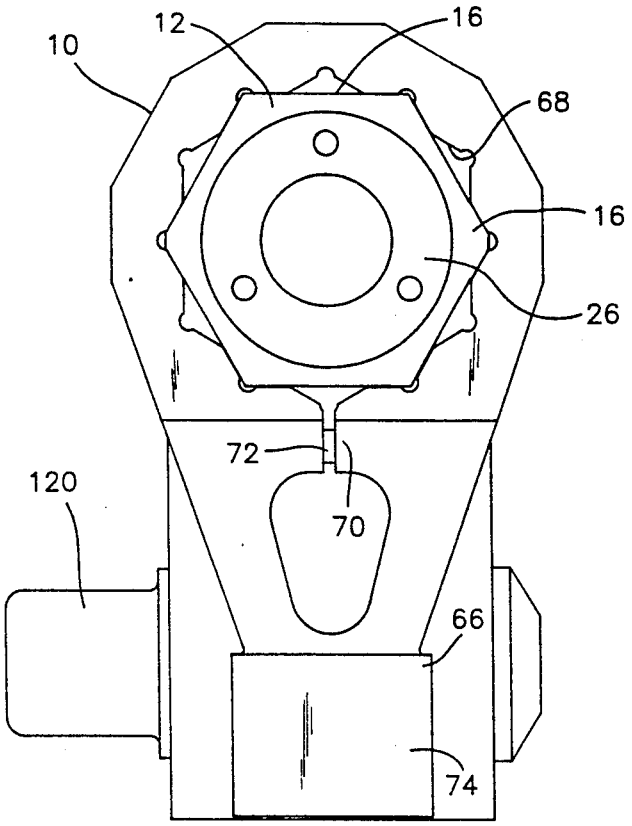
FIG. 5 is a rear elevational view of the wrench as seen from the right side of FIG. 4 and with the handle removed.

The exterior of the rear end 16 is hexagonal as may be seen in FIG. 5 and a reaction bar or abutment assembly 66 is provided and includes a twelve sided polygonal opening 68 therethrough. The reaction bar or abutment assembly 66 is slotted as at 70 and a pair of transverse threaded fasteners 72 are provided for clamping the opening 68 about the hexagonal rear end 16. It will be noted that the reaction bar or abutment assembly 66 includes a lower offset portion 74 and accordingly, the reaction bar or abutment assembly 66 may be releasably secured in twelve angular rotated positions with the lower offset portion 74 projecting rearwardly beyond the rear end 16 and twelve additional angularly displaced positions with the lower offset portion 74 spaced forward of the rear portion 16. Further, the hexagonal shape of the cylinder or rear end portions 16 provides a structural strength to offset the torsional deflection and other stresses created in the wrench 10.

Figure 2A:
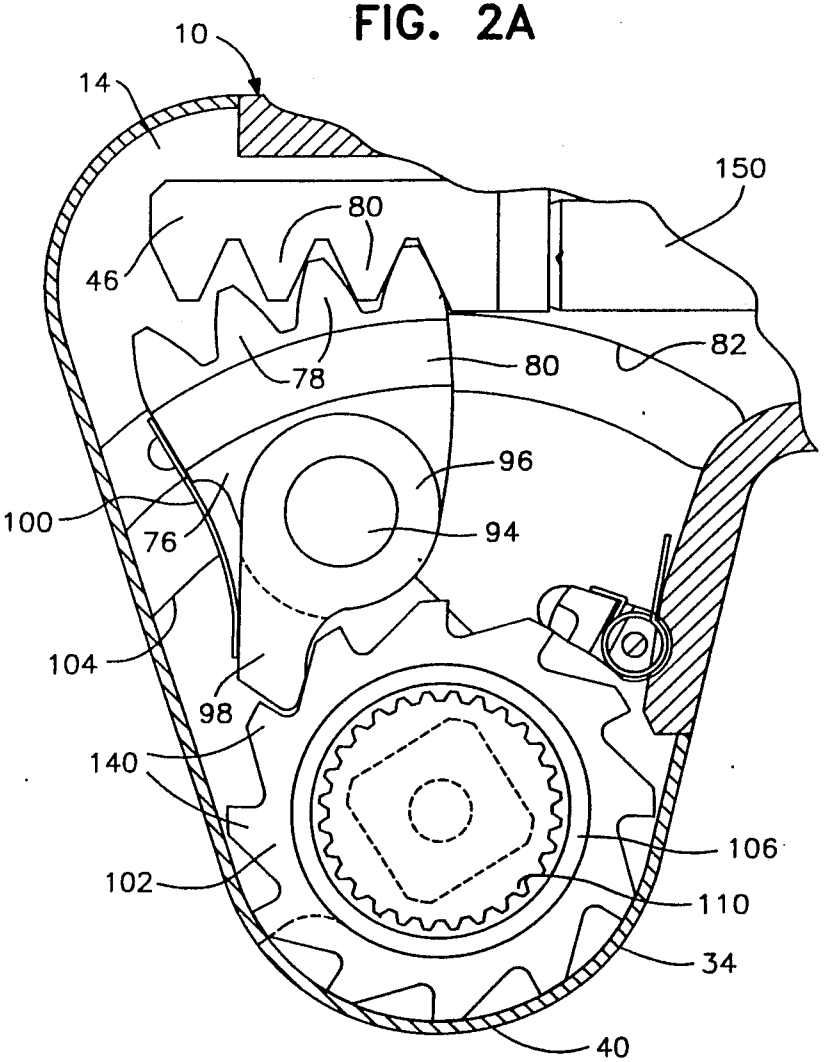
FIGS. 2 and 2A are enlarged fragmentary vertical sectional views similar to the left hand portion of FIG. 1 but illustrating the rack and sector gears as well as the primary and secondary pawls in alternate positions.
Figure 2:
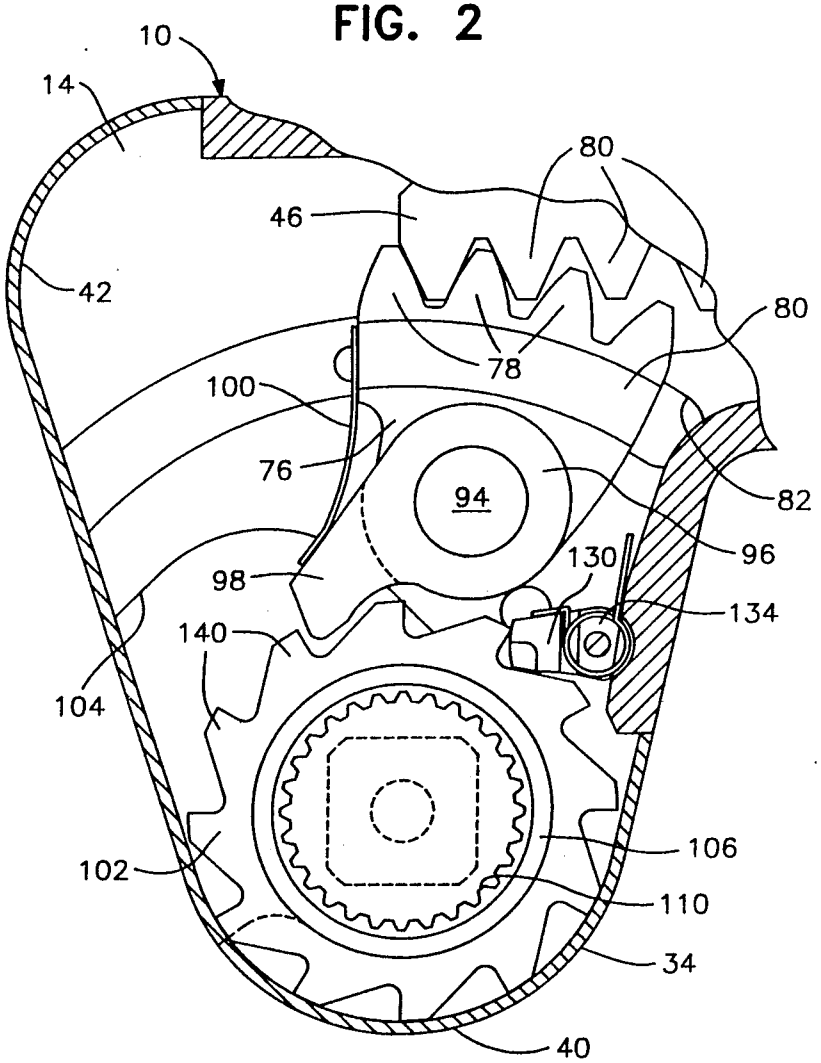
Figure 3:
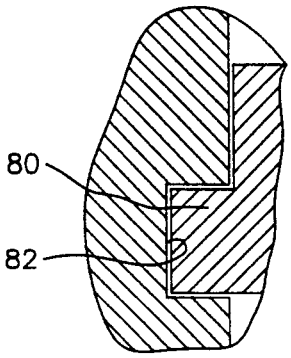
FIG. 3 is a fragmentary enlarged transverse vertical sectional view illustrating the manner in which the opposite side shoulders of the sector gear are guideingly engaged in opposing arcuate grooves formed in the side walls of the hollow body of the wrench.

With attention now invited more specifically to FIGS. 1, 2 and 2A, there may be seen a toothed sector gear 76 including teeth 78 meshed with the teeth 80 of the ratchet gear portion 46. The opposite sides of the sector gear 76 include laterally outwardly projecting arcuate shoulders 80 which are slidingly and guidingly received in registered arcuate grooves 82 formed in the side walls 36 and 38, the grooves 82 being concentric with a pair of registered first and second opposite side journal openings 86 and 88 formed in the side walls 36 and 38 and the openings 86 and 88 including inner end shoulders 90 and 92, respectively.

Pivotally supported from the sector gear 76 by a pivot pin 94 is the upper bifurcated portion 96 of a main drive pawl 98, a resilient leaf spring 100 interacting between the sector gear 76 and the pawl 98.

The front wall 42 is removable and may receive the sector gear 76 and pawl 98 therethrough and also the main ratchet or power wheel 102. The inner surfaces of the side walls 36 and 38 are relieved as at 104 to receive the opposite axial end cylindrical shoulders 106 of the ratchet wheel 102 between the side walls 36 and 38 each relieved area includes a portion thereof which is semicylindrical and coaxial with the lower rear positions of the openings 86 and 88. The ratchet wheel is provided with a central non-circular opening therethrough defining internal splines 110 spaced thereabout and an externally splined elongated drive member 112 is provided and includes first and second ends 114 and 116. The splined portion of the drive member 112 is snugly received through the interior splined portion 110 of the ratchet wheel 102 and second end 116 includes a cylindrical portion 118 which is journaled in the opening 88 and includes a noncircular outwardly projecting terminal end 120 with which a wrench socket may be releasably and telescopically engaged.

The first end 114 is noncircular and has removably secured thereover an end cap 122 journaled in the opening 86 and closely opposing the shoulder 90 while the portion 88 closely opposes the shoulder 92, the end cap 122 being removably secured on the end 114 through the utilization of a removable threaded fastener 124 and including a noncircular recess 126 of the size and shape complementary to the noncircular reduced first end 114 of the drive member 122. Thus, the drive member 112 is rotatably journaled from the body 12 and the threaded fastener 124 may be removed for removal of the end cap 122, withdrawal of the drive member 112 and then reinstallment of the drive member 112 in end to end reversed position.

The upper portion of the body 12 has bores 123 and 125 formed therein to which hydraulic lines may be operatively connected and the bores 123 and 125 open into opposite end portions of the piston bore 18 closely adjacent the adjacent sides of the O-ring 24 and the seal assembly 30 whereby hydraulic fluid under pressure may be pumped into and vented from selected opposite ends of the piston bore 18 in order to effect reciprocation of the piston assembly 48 within the piston bore 18.

Figure 6:
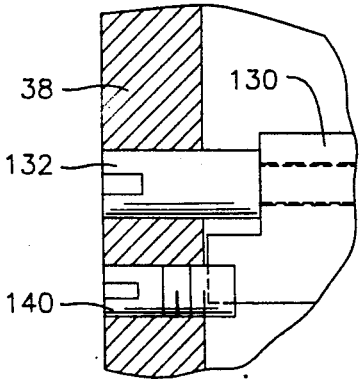
FIG. 6 is an enlarged fragmentary horizontal sectional view illustrating the manner in which the secondary pawl may be releasably locked in in operative position, when desired.
Figure 4:
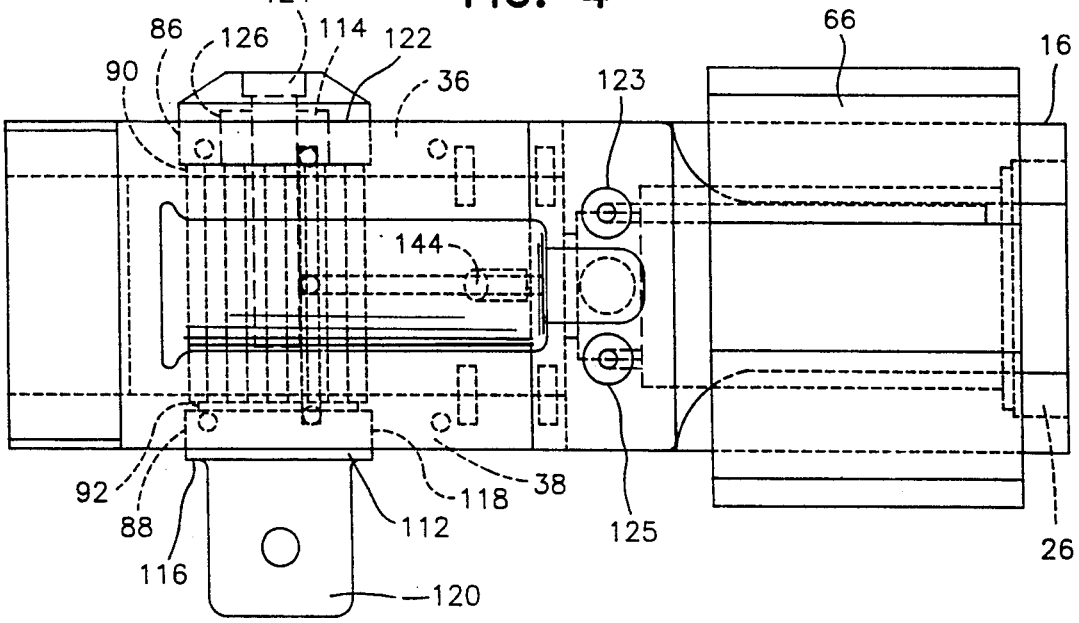
FIG. 4 is a top plan view of the wrench with the hydraulic lines thereto removed.

The main drive pawl 98 is augmented by a secondary pawl 130 pivotally supported between the side walls 36 and 38, see FIG. 6 through the utilization of a pivot fastener 132 and the secondary pawl 130 is spring biased as at 134 to the position thereof illustrated in FIGS. 1 and 2.

In operation, as the piston assembly 48 is fully reciprocated in the piston bore 18, the rack gear portion 46 angularly displaces the sector gear 76 slightly more than 30° about the openings 86 and 88 and thereby advances the ratchet wheel 102 slightly more than 30°. As the ratchet wheel is advanced slightly more than 30°, the secondary pawl 130 falls behind the second tooth 140 rearward of the tooth 140 engaged by the pawl 98 to prevent reverse movement of the ratchet wheel 102. Of course, inasmuch as the secondary pawl 130 is spring loaded, it may swing to the position thereof illustrated in FIG. 2A as the ratchet wheel 102 is advanced 30° (two teeth 140) and soon after the ratchet wheel 102 has been advanced more than 30° the secondary pawl 130 will fall downward behind the tooth 140 just moved therepast. Then, the rack gear portion 46, sector gear 76 and primary pawl 98 may be retracted rearwardly as the piston assembly 48 moves toward its rearmost position in the piston bore 18.

If, however, the reaction ar or abutment assembly 66, because of flexure forces and torsional forces acting upon a bolt being turned, causes the wrench to become bound as the secondary pawl 130 engages behind the corresponding tooth 140, the secondary pawl 130 may be deactivated the next time the piston assembly 48 is forwardly displaced even a slight amount to unload the secondary pawl 130 by applying rotational torque to the fastener 132 to which the secondary pawl is keyed for rotation and thereafter inwardly threading the set screw 140 operatively associated with the pawl 130 to maintain the latter in a position swung slightly upward pass the position thereof illustrated in FIG. 2A.

With attention now again invited more specifically to FIG. 1 of the drawings, it may be seen that a lubrication bore 144 is formed in the body 12 and may be equipped with a suitable grease fitting such as Zerk fitting. The lubrication passage 144 opens downwardly on top of a wear bar or pad 146 carried by the upper side of the rack gear portion 46 downwardly through the side walls 36 and 38 into the inner portions of the openings 86 and 88 and also into the grooves 82.

In this manner, the entire interior of the forward end 14 of the wrench 10 may be greased when needed.

The foregoing is considered as illustrative only of the principles of the invention. Further, since numerous modifications and changes readily will occur to those skilled in the art, it is not desired to limit the invention to the exact construction and operation shown and described and, accordingly, all suitable modifications and equivalence may be resorted to, falling within the scope of the invention.

What is claimed as new is as follows:

1. A high torque wrench for use in close, dirt contaminated quarters, said wrench including a narrow hollow body having a pair of registered first and second opposite side journal openings of the same diameter formed therein and a power wheel disposed within said body in axial registry with said openings, said power wheel having a central noncircular opening formed therethrough, an elongated drive member having first and second ends and of a cross-sectional shape for sliding, nonrotatable telescopic engagement of said first end into said central opening through either of said journal openings with said second end including a generally cylindrical portion journaled in the corresponding journal opening and a first non-circular terminal end projecting outwardly of said corresponding journal opening, said first end including a reduced second non-circular terminal end loosely disposed in the corresponding journal opening, a cylindrical end cap removably telescoped over and secured and keyed to said reduced second non-circular terminal end for rotation therewith and journaled in the corresponding journal opening, said journal openings including radially inwardly projecting shoulder means at the adjacent ends thereof immediately inwardly of and opposing the adjacent ends of said end cap and generally cylindrical portion, said first non-circular end being adapted to have a wrench socket removably coupled thereto, said drive member, upon removal of said cap, being removable from and reversely insertable through said central noncircular opening prior to reinstallment of said end cap, said body including power means operative to rotate said power wheel.

2. The wrench of claim 1 wherein said power wheel comprises a ratchet wheel and said power means includes a driven reciprocal means and a main ratchet pawl operative associated with said reciprocal means and ratchet wheel for intermittently angularly displacing said ratchet wheel in one direction of rotation thereof responsive to reciprocation of said driven reciprocal means.

3. The wrench of claim 2 including a secondary ratchet pawl operatively associated with said ratchet wheel to prevent reverse rotation thereof when said driven reciprocal means is being retracted relative to said one direction of rotation of said ratchet wheel.

4. The ratchet wheel of claim 3 including means operative to deactivate said secondary ratchet pawl.

5. The ratchet wheel of claim 1 wherein said body is elongated with said power wheel disposed adjacent one end thereof, the other end of said body being regular polygonal in cross-sectional shape about an axis extending longitudinally of said body, and an elongated reaction arm including first and second ends, said second end having a regular polygonal cross-sectional shaped opening formed transversely therethrough complemental to the size and cross-sectional shape of the other end of said body releasably clamp engageable with said body other end with the latter disposed in said regular polygonal shape opening.

6. A high torque wrench for use in close dirt contaminated quarters, said wrench including a narrow hollow body having a pair of registered first and second opposite side journal openings of the same diameter formed therein and a power wheel disposed within said body in axial registry with said openings, said power wheel having a central non-circular opening formed therethrough, an elongated drive member having first and second ends and of a cross-sectional shape for sliding, non-rotatable telescoping engagement of said first end into said central opening through at least one of said journal openings with said second end including a generally cylindrical portion journaled in the corresponding journal opening and a first non-circular terminal end projecting outward of said corresponding journal opening, said first end also being journaled in the corresponding journal opening, said hollow body including side walls between which said power wheel is disposed and in which said journal openings are formed, registered arcuate grooves formed in said side walls concentric with said journal openings, a sector gear oscillateable in said housing and including opposite side elongated shoulders slidingly and guideingly received in said grooves, said sector gear including a portion inward of said arcuate grooves and shoulders from which a main drive pawl is pivotally supported, said power wheel comprising a ratchet wheel with peripheral teeth selectively engageable by said main pawl, said body including a driven reciprocal rack gear guidingly supported in said body and having rack gear teeth meshed with said sector gear.

7. The wrench of claim 6 including a secondary spring biased pawl pivotally supported in said housing and operative to engage the teeth on said power wheel to prevent reverse rotation thereof.

8. The wrench of claim 6 wherein said portion of said sector gear inwardly of said shoulders and grooves is relatively narrow and said main ratchet pawl includes a bifurcated portion pivotally supported from said relatively narrow sector gear portion.

9. The ratchet wheel of claim 8 wherein said body is elongated with said power wheel disposed adjacent one end thereof, the other end of said body being regular polygonal in cross-sectional shape about an axis extending longitudinally of said body, and an elongated reaction arm including first and second ends, said second end having a regular polygonal cross-sectional shaped opening formed transversely therethrough complemental to the size and cross-sectional shape of the other end of said body releasably clamp engageable with said body other end with the latter disposed in said regular polygonal shape opening.

* * * * *